US005822646A

United States Patent [19]

Kinoshita et al.

[11] Patent Number: 5,822,646

[45] Date of Patent: Oct. 13, 1998

[54] IMAGE FORMING APPARATUS

[75] Inventors: Masahide Kinoshita, Shizuoka-ken; Jun Suzuki, Numazu, both of Japan

[73] Assignee: Canon Kabushiki Kaisha, Tokyo, Japan

[21] Appl. No.: 900,289

[22] Filed: Jul. 25, 1997

[30] Foreign Application Priority Data

Jul. 26, 1996 [JP] Japan ..... 8-215195

[51] Int. Cl.[6] ..... G03G 15/00

[52] U.S. Cl. ..... 399/24; 399/25; 399/26; 399/35

[58] Field of Search ..... 399/24, 25, 26, 399/27, 34, 35

[56] References Cited

U.S. PATENT DOCUMENTS 5,500,716 3/1996 Morishita et al. ..... 399/35

*Primary Examiner*—S. Lee

*Attorney, Agent, or Firm*—Fitzpatrick, Cella, Harper & Scinto

[57] ABSTRACT

An image forming apparatus has an image bearing member, image forming device for forming a developer image on the image bearing member, cleaning device for cleaning the image bearing member, a container for containing therein the developer removed from the image bearing member, life detecting device for detecting the life of a consumptive part in the apparatus, fullness detecting device for detecting whether the quantity of the developer in the container has reached a predetermined quantity, operation stopping device for stopping the operation of the image forming device at predetermined time, and releasing device for releasing the stoppage of the operation of the image forming device.

3 Claims, 12 Drawing Sheets

IMAGE FORMING APPARATUS

BACKGROUND OF THE INVENTION

1. Field of the Invention

This invention relates to an image forming apparatus such as a copying apparatus or a printer.

2. Related Background Art

An image forming apparatus using the electrophotographic image forming process has heretofore adopted a process cartridge system in which an electrophotographic photosensitive member and process means acting on this electrophotographic photosensitive member are integrally made into a cartridge which is removably mountable a main body of the image forming apparatus. According to this process cartridge system, the maintenance of the apparatus can be done not by a serviceman but by a user himself and therefore, the operability of the apparatus can be markedly improved, and this system is widely used in image forming apparatuses. In the image forming apparatus using the above-described process cartridge system, the user himself must interchange the cartridge and therefore, when a toner has been consumed or when a part such as a photosensitive drum has reached its life, means for informing the user of the fact becomes necessary.

The life of a developing device is the time when the toner has been consumed and the density of image becomes thin, and in this case, the user is informed with the amounts of remaining toner detected by various remaining toner amount detecting means and the quality of image before the toner is completely exhausted being sufficiently satisfied. On the other hand, the life of parts such as the photosensitive drum and a cleaning device is the time when due chiefly to the wear of the photosensitive drum itself, the charge holding during the charging of the photosensitive layer thereof becomes insufficient. Thus, it results in the bad formation of image or a toner container in the cleaning device for removing any residual toner on the photosensitive drum becomes full of the toner to overflow outside of it. Again in such case, the user is informed at a time before the bad formation of image and the stain in the image forming apparatus are caused, by various life detecting means for the photosensitive drum and detecting means for the toner filling the interior of the cleaning device.

However, although it has become possible to inform the user more accurately of the interchange time as described above, there is a case where the cartridge is not interchanged and a great deal of printing is effected even if the user knows the life of the cartridge. This is a case where even if the image forming apparatus informs the user of the life of the cartridge during printing, the user continues to print without being aware of it. This is because as previously described, the user is informed of the life at a period of time whereat the quality of image can be guaranteed and judges that printing is still possible and performs the printing operation in a great deal from his necessity, or because when a great deal of printing command has been effected, the user has done other thing without checking up the image forming apparatus.

In such a case, the life of each cartridge may be passed, and particularly, a great problem on the part of the user is the case of a cartridge including a photosensitive drum and a cleaning device. In the case of a developing device when the life thereof is exceeded, a void image is merely outputted, but in the case of a photosensitive drum (and the case of reverse development in which a toner is made to adhere to an exposure portion), the potential difference between the exposure portion and a non-exposure portion becomes null and the development of a non-image portion is effected. Therefore, images of black spots and black streaks are printed in a great deal and thus, not only transfer materials are consumed, but the toner in the developing device is also wasted. In the worst case, a black image due to the general deficiency of potential is developed on the photosensitive drum, thus resulting in a greatly shortened life of a toner container in a cleaning device.

Also, in the case of the cleaning device, the toner container in the device becomes full of a toner and the cleaning of a cleaning blade for removing any residual toner on the photosensitive drum mounted in the apparatus is not done well. The toner rubs through this portion and is transferred to a non-image portion on transfer sheet, or the toner overflows from the toner container to contaminate the interior of the image forming apparatus.

So, as regards a cartridge including a photosensitive drum and a cleaning device, in order to prevent this problem, it is conceivable to control the image forming apparatus so that the user may be informed of the fact that the end of the life of the cartridge is near. Then the printing operation of the image forming apparatus may be forcibly stopped before the life of the cartridge is reached after a predetermined printing operation. However, such control gives rise to a problem in the following case. For example, after a user has been informed of the life, the image forming apparatus performs a predetermined printing operation, and when there is a user who has mounted the cartridge on another image forming apparatus body at timing immediately before the image forming apparatus is forcibly stopped, this image forming apparatus judges the state of the cartridge to be the end of its life. Then it is forcibly stopped after it has performed a predetermined printing operation. Thus, the number of prints for which the apparatus should originally be forcibly stopped is exceeded, and if this is repeated, the apparatus is forcibly stopped at a stage greatly exceeding the life. Therefore, it becomes substantially impossible to control the forcible stoppage, thus resulting in bad images and toner stain.

Against this problem, it is conceivable to utilize a memory as detecting means for the life of the process cartridge. Various propositions to provide a memory in a cartridge have already been made, and for example, in Japanese Patent Laid-Open Application No. 63-212956, there is proposed an electro-photographic recording apparatus wherein a memory is provided in a cartridge and means for effecting reading-out and writing-in is provided in the apparatus body. On the basis of the content read out from the memory and the electrophotographic operation, information related to the life of the cartridge is calculated to be written-in into the memory.

By adopting such a construction wherein a memory capable of reading-out and writing-in is provided in the cartridge and the user is informed of the fact that the end of the life of the cartridge is near. Then, the image forming apparatus is controlled so as to forcibly stop its printing operation before the life of the cartridge is reached after a predetermined printing operation, the state of the cartridge can be accurately judged even when the cartridge is mounted on another image forming apparatus into its course of use, and it has become possible to effect the control of the forcible stoppage well. Further, the effect of utilizing a memory is that more highly accurate detection of the life of the cartridge can be enjoyed.

As described above, the memory is provided in the cartridge and control is effected such that reading-out and writing-in with respect to the image forming apparatus body are effected to thereby judge the state of the cartridge, and the user is informed of the fact that the life of the cartridge is near. Then, the printing operation of the image forming apparatus is forcibly stopped before the life of the cartridge is reached after a predetermined printing operation. Thereby, a good quality of image is maintained for the user, and yet it becomes possible to prevent the problem that the user prints had images in a great deal and transfer materials and toners are wastefully consumed, or the interior of the image forming apparatus is stained with the toners.

However, for a user who had been driven by the necessity of effecting printing at that point of time by all means and does not possess any spare cartridge for interchange, it is not preferable from the viewpoint of usability that as in the above-described example of the prior art, the control of stopping the image forming operation is effected to thereby disable the printing operation from being effected.

On the other hand, as previously described, when the printing operation of the image forming apparatus is possible, it is necessary to guarantee the quality of image and therefore, it is before the problem of the life of the photosensitive drum or the cleaning device, i.e., the problem such as bad image or toner stain, is caused that the printing operation is stopped. It is impossible when the various kinds of life detection accuracy in the prior art and the irregularity, intersection, etc. of parts such as the photosensitive drum, etc. are taken into consideration to control the apparatus so as to stop it immediately before such problem as bad images or toner stain is caused. Accordingly, the printing operation is stopped somewhat before the life of the photosensitive drum or the cleaning device is reached, and it is the present situation that the apparatus is controlled so as to stop its printing operation at a point of time whereat it would be possible to print good images, on some sheets. That is, in spite of the fact that actually, good image can be provided if up to a certain number of sheets, the printing operation of the image forming apparatus is stopped in order to guarantee the quality of image.

Also, as a matter of course, there is a case where it is desired to effect printing even if the resultant image may be somewhat bad, and when such a desire is to be met, it is necessary to make the photosensitive drum or the cleaning device usable until their life is exceeded. In such a case, however, the following problem may arise. Regarding the above-described photosensitive drum, if the user understands the occurrence of a bad image, it will be possible to provide a good image if the photosensitive drum is interchanged later even when it is used beyond its life, but if the photosensitive drum is used until the container of the cleaning device becomes full of the toner, the toner stain in the image forming apparatus will result as previously described. As regards this toner stain, it may stain the user's hand during the interchange, and when the transfer sheet conveying path in the image forming apparatus is stained with the toner, the toner adheres to transfer sheet and stained images continue to be outputted even after the cartridge including at least the cleaning device is interchanged with a new one. In the worst case, the toner comes into the driving portion in the image forming apparatus and causes the trouble of the apparatus.

So, when it is desired to effect printing even if the resultant images may be bad to a certain extent, it will suffice to make the printing operation possible only when the life of the cleaning device is still sufficiently left. But in the example of the prior art, the printing operation has been stopped before the life of each cartridge is reached, without distinguishing between what will cause the above-described problem if used beyond the life and what is not so, depending on the construction of the cartridge. That is, there is a case where the problem as noted above does not arise and the printing operation can be performed, and in spite of being possible to meet the user's desire to effect printing even if the resultant images may be bad to a certain extent, the printing operation of the image forming apparatus has been stopped.

SUMMARY OF THE INVENTION

Accordingly, it is an object of the present invention to provide an image forming apparatus which, when there is no possibility of causing a problem such as the trouble of the apparatus, enables the printing operation to be performed on the basis of a user's own judgment in compliance with the user's many requirements, and a process cartridge mountable on such image forming apparatus.

It is another object of the present invention to provide an image forming apparatus comprising: an image bearing member; image forming means for forming a developer image on said image bearing member; cleaning means for cleaning said image bearing member; a container for containing therein the developer removed from said image bearing member; life detecting means for detecting the life of a consumptive part in said apparatus; fullness detecting means for detecting whether the quantity of the developer in said container has reached a predetermined quantity; operation stopping means for stopping the operation of said image forming means when it receives the detection signal of said life detecting means or the detection signal of said fullness detecting means; and releasing means for releasing the stoppage of the operation of said image forming means, said releasing means receiving a releasing signal when the operation is stopped by the detection signal of said life detecting means, and rejecting the releasing signal when the operation is stopped by the detection signal of said fullness detecting means.

Further objects of the present invention will become apparent from the following detailed description when read with reference to the accompanying drawings.

DESCRIPTION OF THE PREFERRED EMBODIMENTS

An image forming apparatus and a process cartridge according to the present invention will hereinafter be described in greater detail with reference to the drawings.

Embodiment 1

Embodiment 1 of the present invention will first be described with reference to FIGS. 1 to 4.

Figure 1:
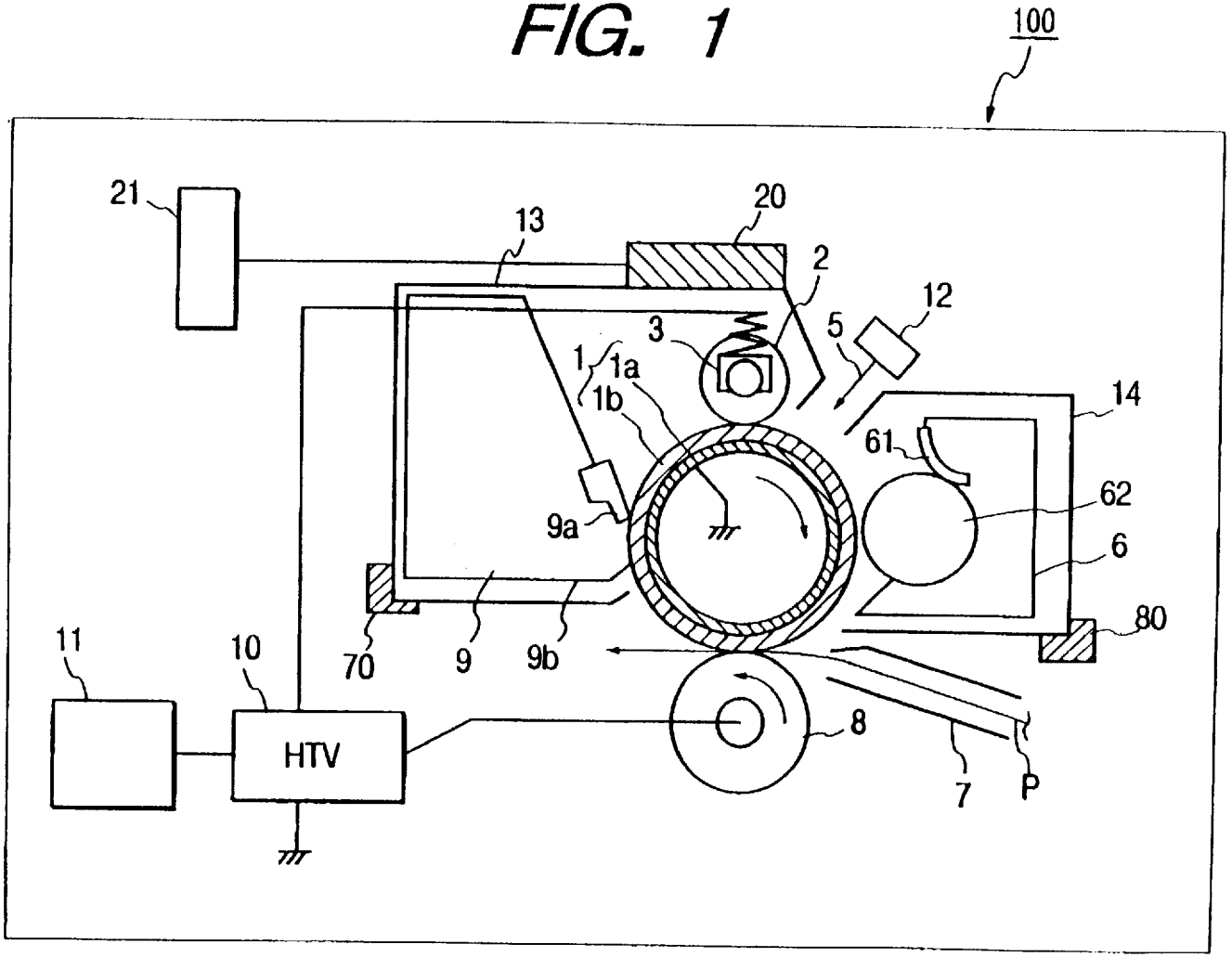
FIG. 1 schematically shows the construction of an image forming apparatus to which Embodiments 1 to 4 of the present invention are applied.
Figure 2:
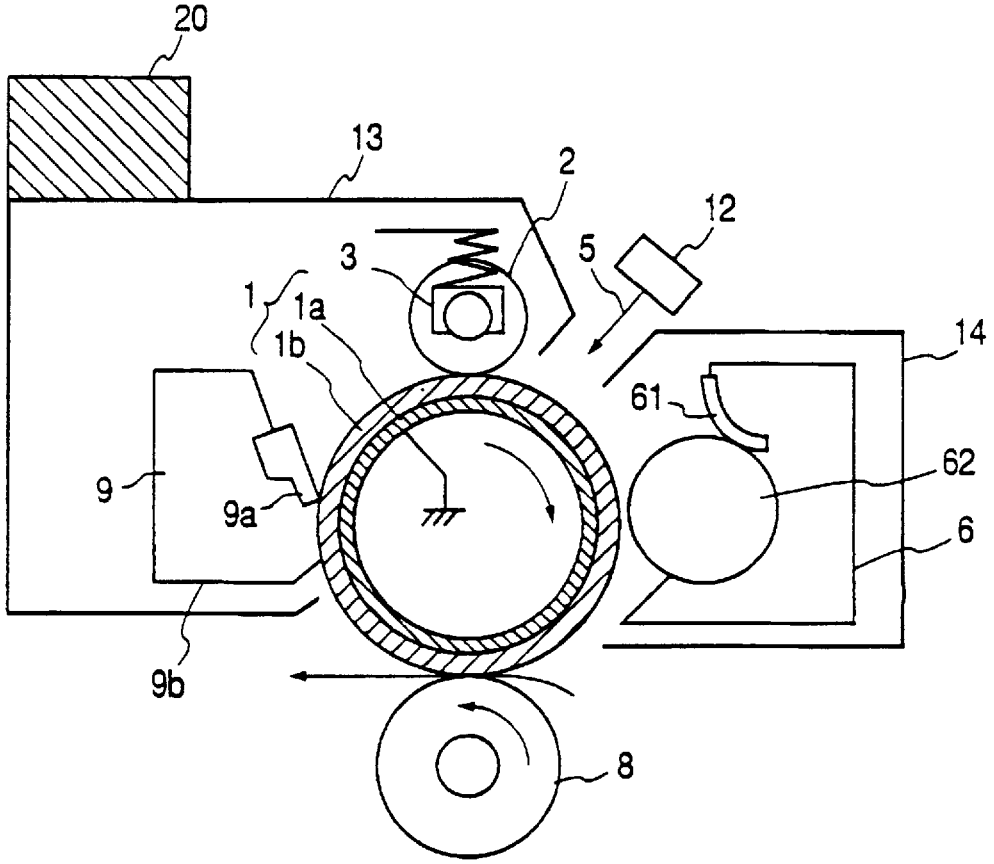
FIG. 2 schematically shows the construction of a process cartridge mounted on the image forming apparatus of FIG. 1.

In FIG. 1, the image forming apparatus 100 of the present embodiment is a laser beam printer utilizing the transfer type electro-photographic process. A photosensitive drum 1 is a type having a diameter of 30 mm and comprising a drum base body 1*a* of an electrically conductive material such as aluminum grounded and a photosensitive layer 1*b* comprising an organic photoconductive layer (OPC) formed on the outer peripheral surface of the drum base body 1*a*, and is rotatively driven in a predetermined direction at a predetermined process speed (peripheral speed), e.g. 100 mm/sec.

A charging roller (charging means) 2 is disposed near the photosensitive drum 1, and a vibration voltage which is a voltage comprising a negative DC voltage and an AC voltage superposed upon each other is applied to the mandrel 3 of the charging roller 2 by a bias applying voltage source 10. At this time, the surface of the photosensitive drum 1 subjected to negative charging by the charging roller 2 is subjected to the scanning exposure by a laser beam 5 outputted from a laser scanner 12 on the basis of image information made into an electrical signal. Thus, the potential of the exposed portion is attenuated and an electrostatic latent image is formed on the surface of the photosensitive drum 1. The latent image is reversely developed by the developing blade 61 of a developing device 6 by the use of a negatively charged toner coating a developing sleeve 62.

On the other hand, a transfer material P is fed from a sheet supply portion (not shown) through a guide 7 (conveying means) to the nip portion (transfer portion) between the photosensitive drum 1 and a transfer roller 8 as a transfer member in timed relationship with the toner image on the surface of the photosensitive drum 1. By a transfer bias of the opposite polarity to the charging polarity of the toner applied from the bias applying voltage source 10 to the transfer roller 8, the toner image on the surface of the photosensitive drum 1 is sequentially transferred to the surface of the transfer material P. The transfer material P which has passed the transfer portion is separated from the surface of the photosensitive drum 1 and is directed to fixating means (not shown) to be subjected to image fixation and is outputted as an image-formed article (a print).

After the separation of the transfer material, the surface of the photosensitive drum 1 is cleaned by a cleaning device 9 provided with a cleaning blade 9*a* for removing any adhering contaminant such as any untransferred toner, and is used repetitively for image formation. This cleaning device 9 contains the untransferred toner in the container 9*b* thereof. The bias applying voltage source 10 has connected thereto a control portion (CPU) 11 for automatically setting predetermined application timing and predetermined potential to the charging roller 2 and the transfer roller 8.

The charging roller 2, the cleaning device 9 and the photosensitive drum 1 are integrally constructed as a process cartridge 13, which is removably mountable with respect to the apparatus body 100 by first mounting guide means 70. Also, a non-volatile memory 20 is carried on the process cartridge 13, and in the present embodiment, an NV (non-volatile) RAM is used as the non-volatile memory 20 from the viewpoints of the ease of handling and cost. Also, the memory 20 is connected to a CPU 21 on the apparatus body by suitable means. The developing means 6 as a developing cartridge is removably mountable with respect to the apparatus body 100 by second mounting guide means 80.

In the case of a process cartridge of a construction in which the charging roller 2, the cleaning device 9 and the photosensitive drum 1 are made integral with one another as in the present embodiment, the end of the life thereof is the time when the container 9*b* of the cleaning device 9 has become full of the residual toner or the time when good charging is not done due to the wear of the photosensitive drum 1 and a bad image is created. However, in the present embodiment, the life of the process cartridge is designed to be determined by the wear of the photosensitive drum 1. That is, the container 9*b* is of a size capable of sufficiently containing therein a quantity of toner obtained by finding (the maximum quantity of toner contained in the container per sheet)×(the maximum number of prints including the irregularity of the life of the photosensitive drum 1) by an experiment and a calculation. Therefore, in the present embodiment, there is not provided toner fullness detecting means for the cleaning device 9.

The wear of the photosensitive drum 1 which determines the life of this process cartridge 13 is determined from such factors as the frictional sliding time of the cleaning blade and the AC bias application time of the changing roller 2. The end of the life comes at a point of time whereat the wear has progressed and the film thickness of the photosensitive layer has become below the necessary film thickness. So, a relational expression between these factors and the amount of wear is derived from an experiment. A value $\alpha$ corresponding to the amount of wear of the photosensitive drum 1 is calculated from this relational expression, control is effected such that exchange warning is first displayed when this value a exceeds a first predetermined value $\beta 1$, and the printing operation of the image forming apparatus is stopped when the value $\alpha$ exceeds a second predetermined value $\beta 2$.

Figure 3A:
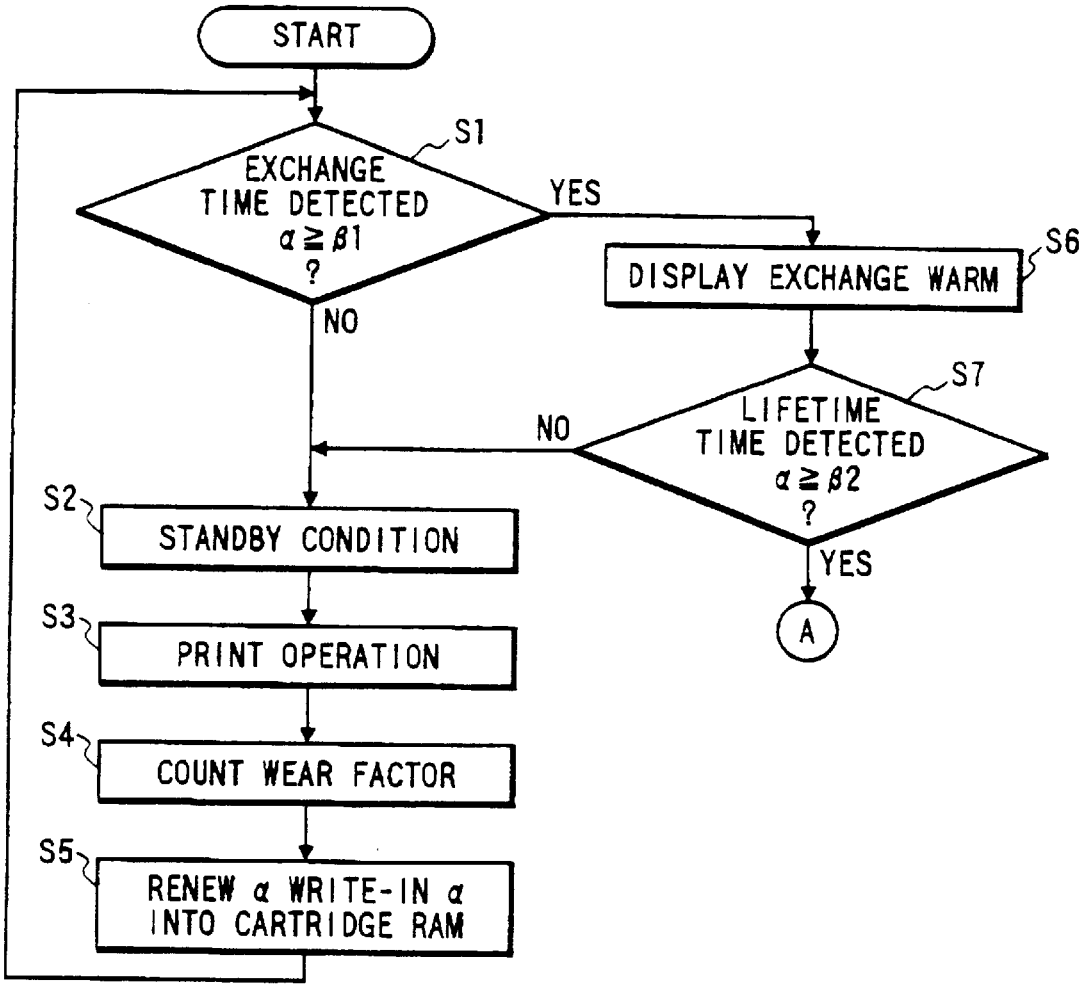
FIGS. 3A and 3B are flow charts for illustrating Embodiment 1 of the present invention.
Figure 3B:
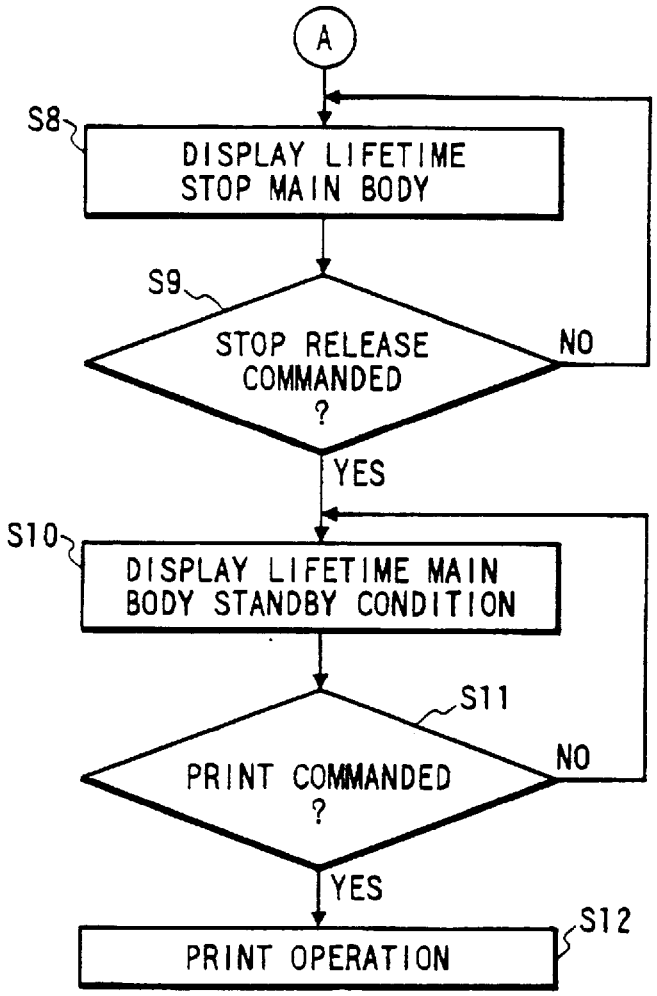

The control in the present embodiment will now be described with reference to the flow charts of FIGS. 3A and 3B in particular.

First, comparative values $\beta 1$ and $\beta 2$ ($\beta 1<\beta 2$) are put into the memory 20 of the process cartridge 13 in advance, and an area for storing the value of a therein is secured. When the process cartridge 13 has been mounted on the image forming apparatus, the memory 20 becomes connected to the CPU 21 of the image forming apparatus. In this state, the power source of the image forming apparatus is switched on, the CPU 21 reads the used state $\alpha$ from the memory 20.

Next, the used state $\alpha$ is compared with the comparative value $\beta 1$ by the CPU 21 (S1), and when $\alpha<\beta 1$, nothing is displayed and the image forming apparatus is initialized and warmed up, and is brought into a standby condition (S2). Then, the printing operation is performed in accordance with an image forming signal (S3). At this time, in the CPU 21, the used state, i.e., the calculated value $\alpha$ according to the above-described wear factor, is counted (S4), and the used state $\alpha$ is renewed to be written into the memory of the cartridge (S5).

On the other hand, when at a step 1 (S1), the used state a is the same as the comparative value $\beta 1$ or has become greater than the comparative value $\beta 1$, a signal for demanding the exchange of the process cartridge is produced and displayed (S6).

Subsequently, in the CPU 21, the used state $\alpha$ is compared with the comparative value $\beta 2$ (S7), and when $\alpha<\beta 2$, nothing is displayed and the afore-described steps S2 to S5 are carried out. At each predetermined time, when the door is opened, or when the power source is OFF, the used state α is renewed in the memory 20. When the used state a has become the same as the comparative value β2 or greater than the comparative value β2 while these operations are repetitively performed, the user is informed that the process cartridge has come to the end of its life. With this life, the image forming operation is inhibited (S8).

The values β1 and β2 are stored in advance in a predetermined area of the memory in the image forming apparatus or in the cartridge 13. For example, when cartridges originally differing in life from one another are prepared as a lineup of products and the initial film thicknesses of respective photosensitive drums differ from one another, the limit value of the above-mentioned amount of wear which is the life differs. Therefore, in such a case, it is necessary to store β1 and β2 in a predetermined area of the memory in the cartridge 13.

When subsequently to the step 8 (S8), it is judged that the user wants to perform the printing operation (S9), a switch provided on the image forming apparatus body is closed or a command from a computer terminal connected to this image forming apparatus is carried out, so that the printing operation of the image forming apparatus which has been stopped can be resumed. After this printing operation has been resumed, the printing operation is possible for any desired number of sheets by the user's judgment.

After a command for releasing the stoppage of the printing operation has been received at a step 9 (S9), the life is displayed and the apparatus body is brought into a standby condition (S10), and then a printing command is received (S11), then the printing operation is performed (S12).

By doing so, a user who has been driven by the necessity of effecting printing at that point of time by all means and does not possess any spare cartridge for interchange is informed that the life of the process cartridge has been reached. Thus, the possibility of a bad image occurring is indicated to the user, then the user Can resume the image forming operation by his own judgment.

In the present embodiment, as previously described, the cartridge 13 is designed such that the photosensitive drum 1 exceeds the life thereof before the container 9*b* of the cleaning device 9 becomes full of the toner. Therefore, the toner stain from the container 9*b* will not occur even if the user resumes the printing operation of the image forming apparatus. Also, to a user who cannot approve the occurrence of a bad image, cartridge exchange warning is given in advance before the image forming apparatus is forcibly stopped, so that, such user can afford to prepare a spare cartridge for interchange.

While in the present embodiment, β1 and β2 have been stored in advance as the predetermined values for comparison, β1 alone may be stored as the predetermined value and control may be effected such that the number of printed sheets is counted after the exchange warning. The above-described life warning and the forcible stoppage of the image forming operation are done at a stage whereat a predetermined number of sheets has been reached.

Embodiment 2

Figure 4:
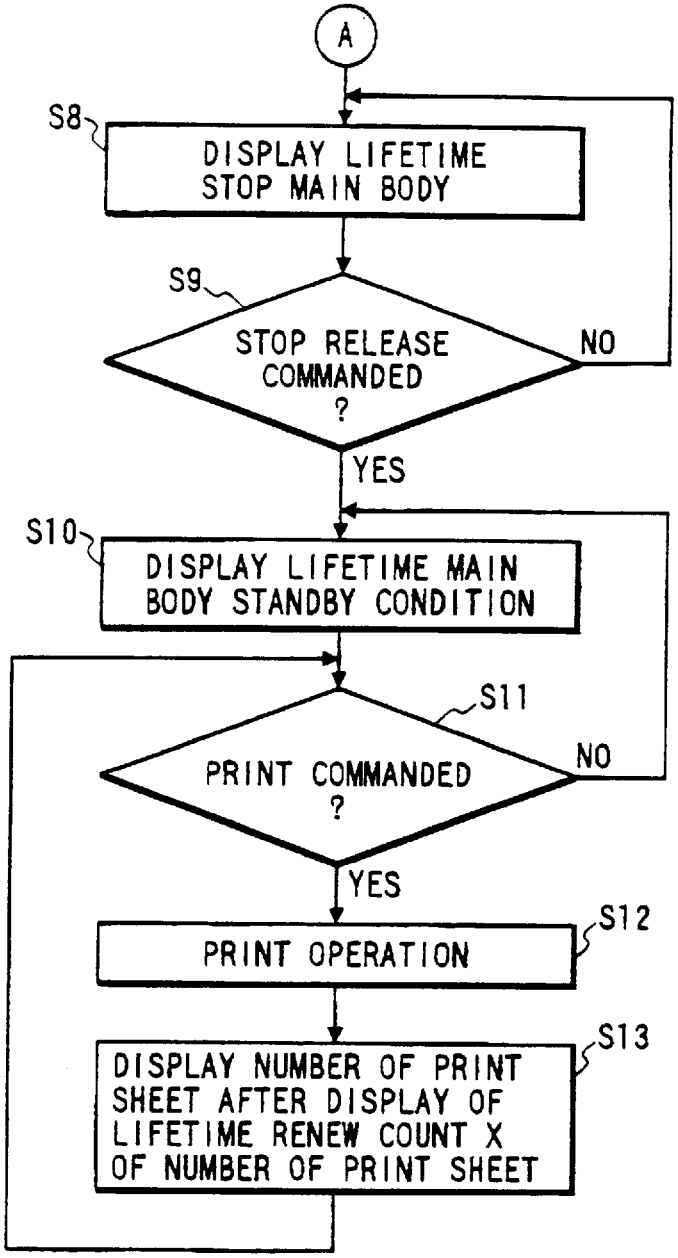
FIG. 4 is a flow chart for illustrating Embodiment 2 of the present invention.

Embodiment 2 of the present invention will now be described with reference to the flow chart of FIG. 4.

While in Embodiment 1, any number of sheets can be printed on the basis of the user's judgment after the stoppage has been released after the forcible stoppage of the image forming apparatus body, but Embodiment 2 is designed such that the number of printed sheets after the display of the life thereof can be displayed. That is, a command for releasing the stoppage is given by the user closing a switch provided in the image forming apparatus body or by an input from a computer terminal connected to the image forming apparatus (S9), and the life is displayed and also the apparatus body is brought into a standby condition (S10). Then a printing command is received (S11) to resume the printing operation (S12). Up to this is similar to Embodiment 1.

In Embodiment 2, the number of printed sheets after the printing operation has been resumed is counted, and is written as added data X into the memory in the image forming apparatus or in the cartridge 13. This number of printed sheets is displayed by a display device (S13). Thereby the user can grasp the number of sheets printed after the life of the cartridge.

This added data X should desirably be written into the memory in the cartridge 13. It is because even when this cartridge 13 is mounted on another image forming apparatus after the printing operation has been resumed, it becomes possible to judge to what degree printing has been done after the display of the life.

Thereby, in addition to the effect of Embodiment 1, the user can confirm to what degree printing has been done after the display of the life, and can confirm the number of printed sheets and the level of the image thereon. As a result, when the user has printed similar images by the use of several cartridges, the user can judge to some extent up to how many sheets can be printed after the display of the life to grasp and the user's own interchange.

Embodiment 3

Figure 5:
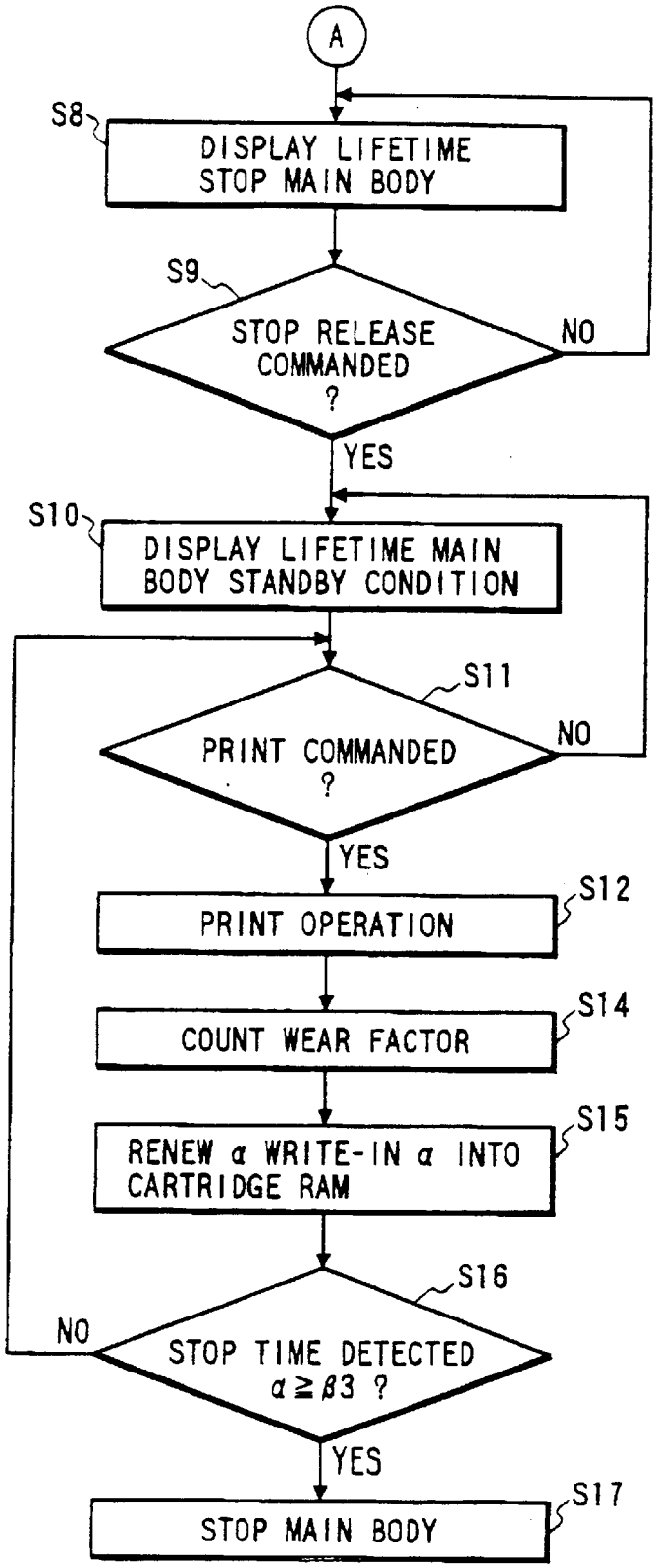
FIG. 5 is a flow chart for illustrating Embodiment 3 of the present invention.

Embodiment 3 of the present invention will now be described with reference to the flow chart of FIG. 5.

While in Embodiment 1, any number of sheets can be printed on the basis of the user's judgment after the stoppage has been released after the forcible stoppage of the image forming apparatus body. However, control is effected in Embodiment 3 so that the image forming apparatus may be again forcibly stopped after the release of the stoppage. That is, a third comparative value β3 is predetermined. When the printing operation has been performed after the release of the forcible stoppage (S12), the life factor is counted (S14), and the used state α of the photosensitive drum 1 is removed to be written into the memory (S15). Control is effected so that when this a exceeds β3, the image forming apparatus may be again forcibly stopped (S17). That is, in Embodiment 3, β1, β2 and β3 of three levels are stored in advance as comparative values and are compared with the used state α of the photosensitive drum 1, so that the interchange of the cartridge 13, the display of the life thereof and the forcible stoppage, and the second forcible stoppage after the forcible stoppage are effected.

By controlling so, the image forming apparatus can be prevented from greatly passing its life during printing even if after the printing has been resumed after the display of the life, the user commands a great deal of print and does not check up the image forming apparatus thereafter. As a result, a great deal of print can be prevented from being outputted without the user being aware of very bad images.

Embodiment 4

Embodiment 4 of the present invention will now be described with reference to the flow chart of FIG. 6.

Figure 6:
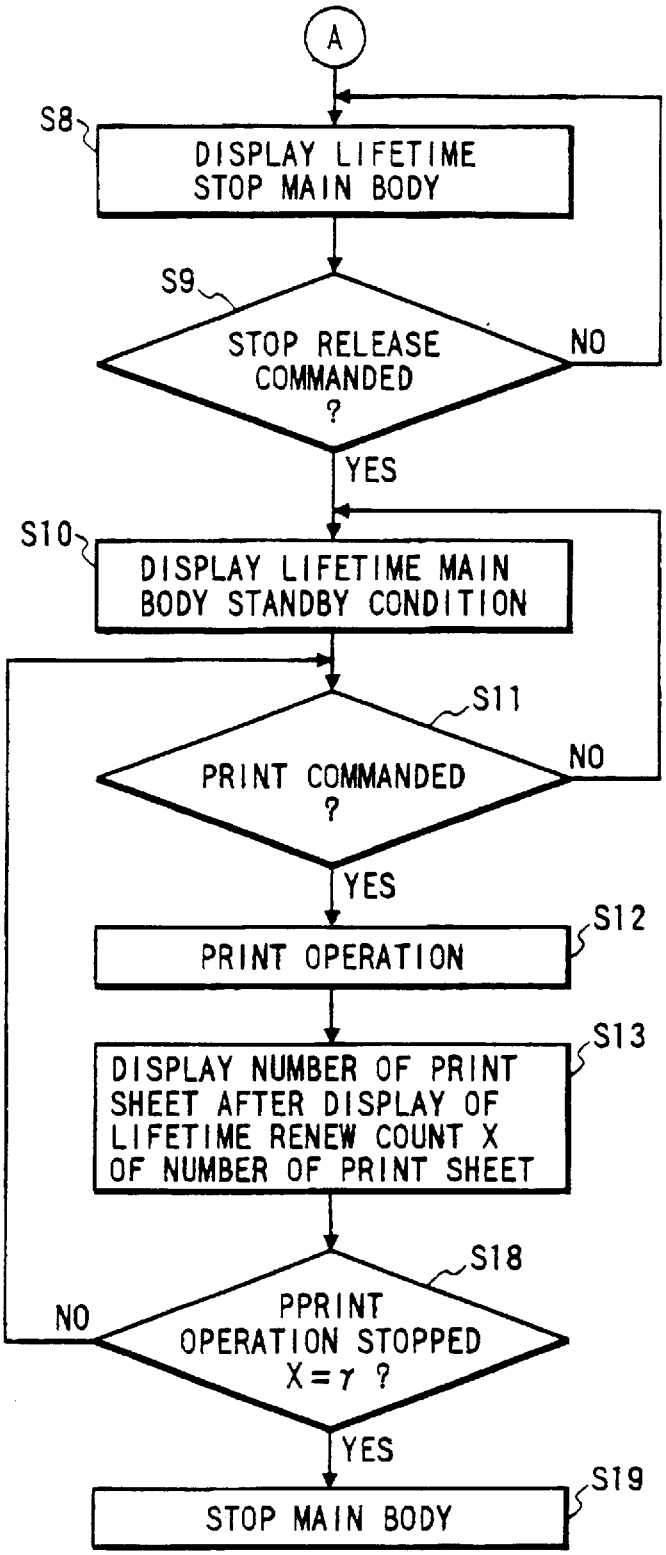
FIG. 6 is a flow chart for illustrating Embodiment 4 of the present invention.

While in Embodiment 2, the number of printed sheets after the display of the life can be displayed, but control is effected in Embodiment 4 so that as shown in FIG. 6, the printing operation may be forcibly stopped after the number of printed sheets has reached a predetermined number. That is, the number of sheets printed after the printing operation has been resumed is counted and is sequentially written as added data X into the memory in the image forming apparatus or in the cartridge 13 (S13). This added data X is compared with a predetermined number of sheets γ (S18), and control is effected so that at a point of time whereat this γ has been reached, the printing operation of the image forming apparatus may be forcibly terminated (S19).

By controlling so, as in Embodiment 3, the image forming apparatus can be prevented from greatly passing its life during printing even if after the printing has been resumed after the display of the life, the user commands a great deal of print and does not check up the image forming apparatus thereafter. As a result, a great deal of print can be prevented from being outputted without the user being aware of very bad images. Further, the number of printable sheets γ is displayed, so that the user can know that printing can be done only up to the number of printable sheets γ after printing has been resumed.

Control may be effected so that even after the forcible termination in the present embodiment, the forcible stoppage can be again released, and control may be effected so that the apparatus may be forcibly stopped after a predetermined number of sheets have been printed.

Embodiment 5

Embodiment 5 of the present invention will now be described with reference to FIGS. 7, 8A and 8B.

Figure 7:
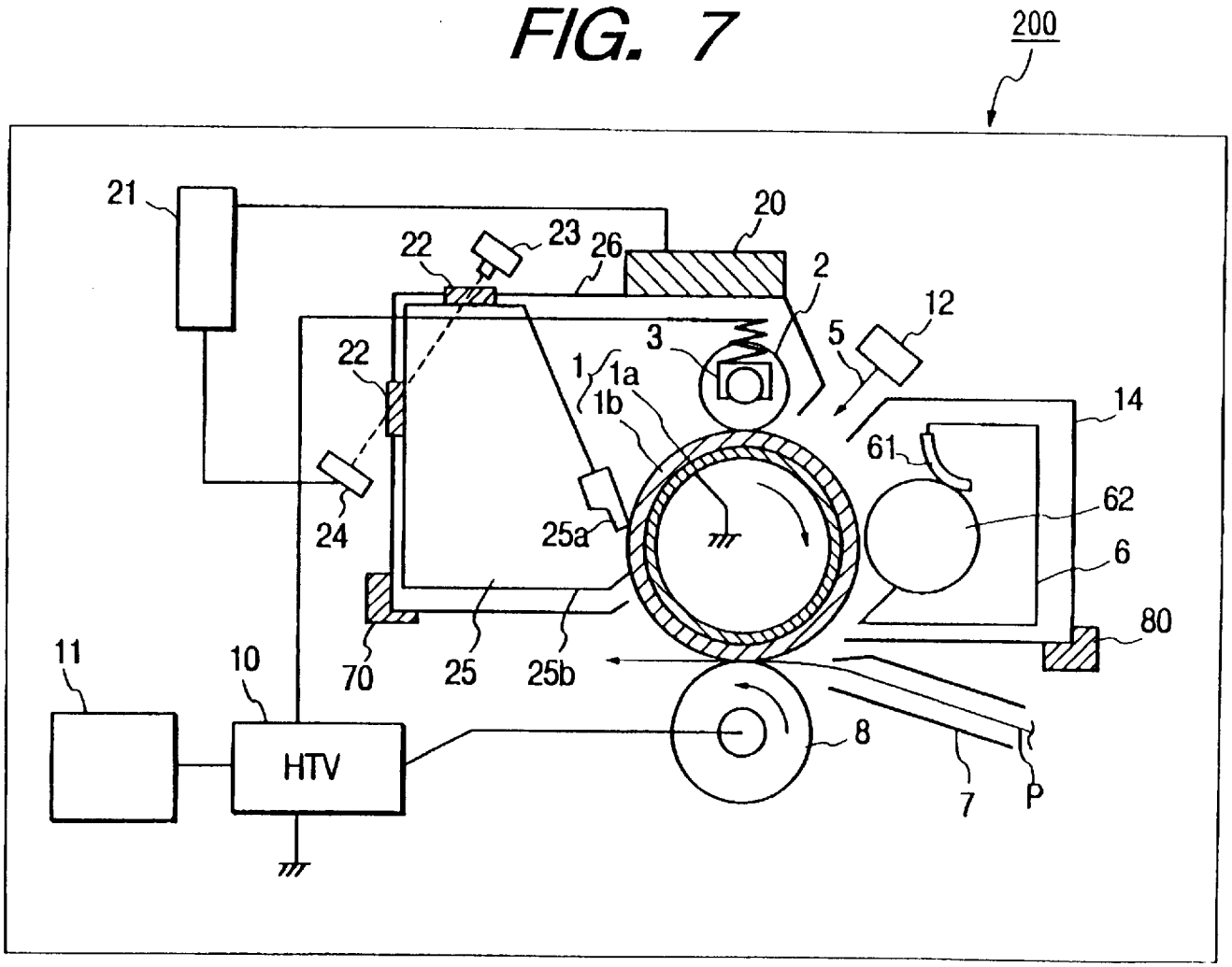
FIG. 7 schematically shows the construction of an image forming apparatus to which Embodiment 5 of the present invention is applied.

Another embodiment of the image forming apparatus according to the present invention is shown in FIG. 7. The construction of the image forming apparatus 200 according to the present embodiment is similar to that of the aforedescribed embodiments in that a process cartridge 26 adopts a construction in which the charging roller 2, the cleaning device 25 and the photosensitive drum 1 are made integral with one another, but differs from it in that the toner fullness detecting means 23 and 24 is provided for the cleaning device 25.

As shown in FIG. 7, transmission windows 22 are provided at two locations in the upper corner portion of the container 25b of the cleaning device 25. The transmission windows 22 are located in the optical path between a light emitting element 23 and a light receiving element 24 which are provided in the image forming apparatus body. By adopting such a construction, it can be detected that the cleaning device 25 is filed with the toner and is full of the toner when the toner intercepts the optical path between the light emitting element 23 and the light receiving element 24.

Besides this, as the fullness detecting means, the conventional detecting means such as so-called antenna detection utilizing two antenna-like electrodes provided in the cleaning device, and utilizing a change in electrostatic capacity conforming to the quantity of toner lying therebetween, or a detecting method utilizing a change in the driving torque of a toner feeding mechanism in the cleaning device conforming to the quantity of toner can be used.

Figure 8A:
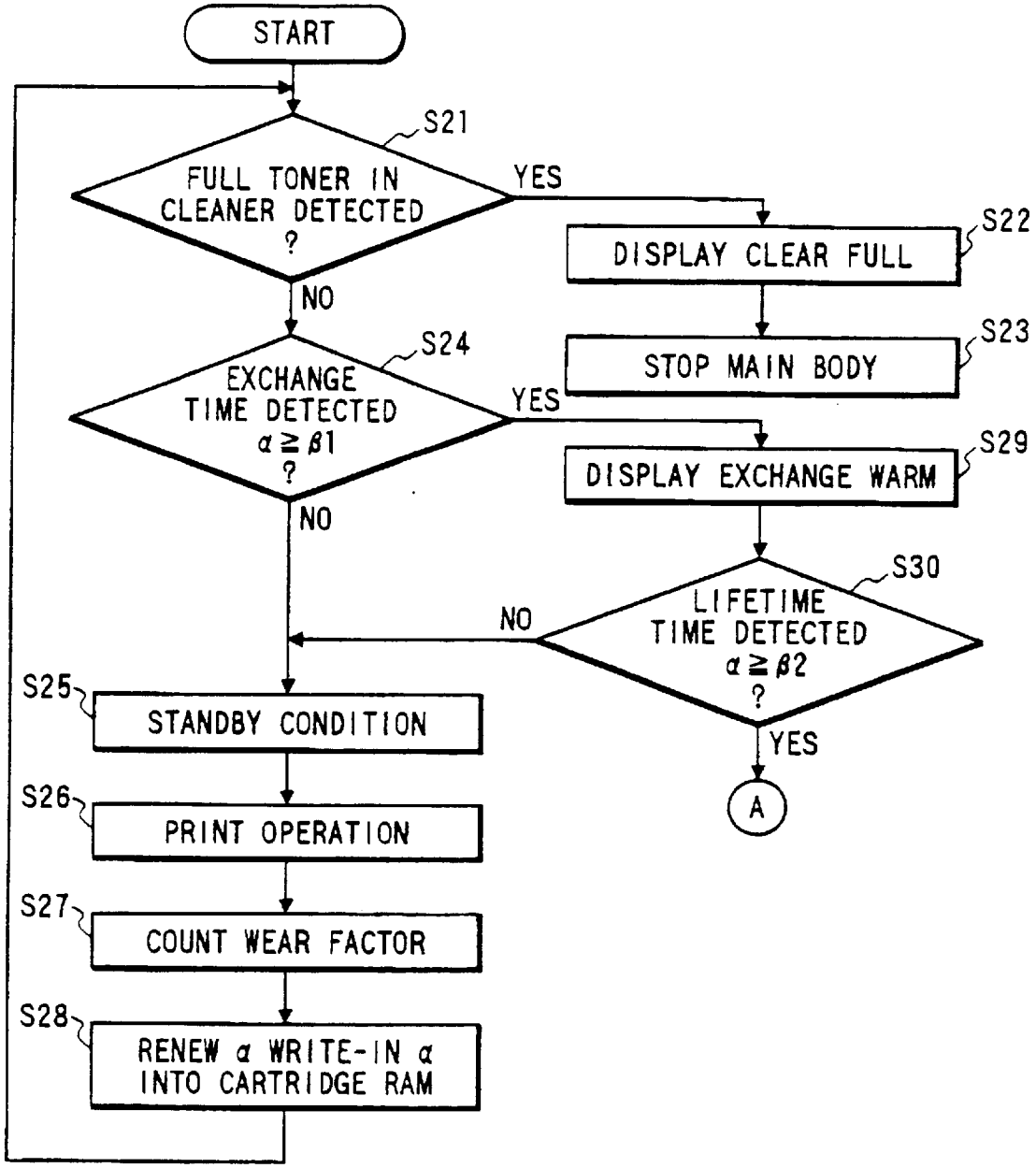
FIGS. 8A and 8B are flow charts for illustrating Embodiment 5 of the present invention.
Figure 8B:
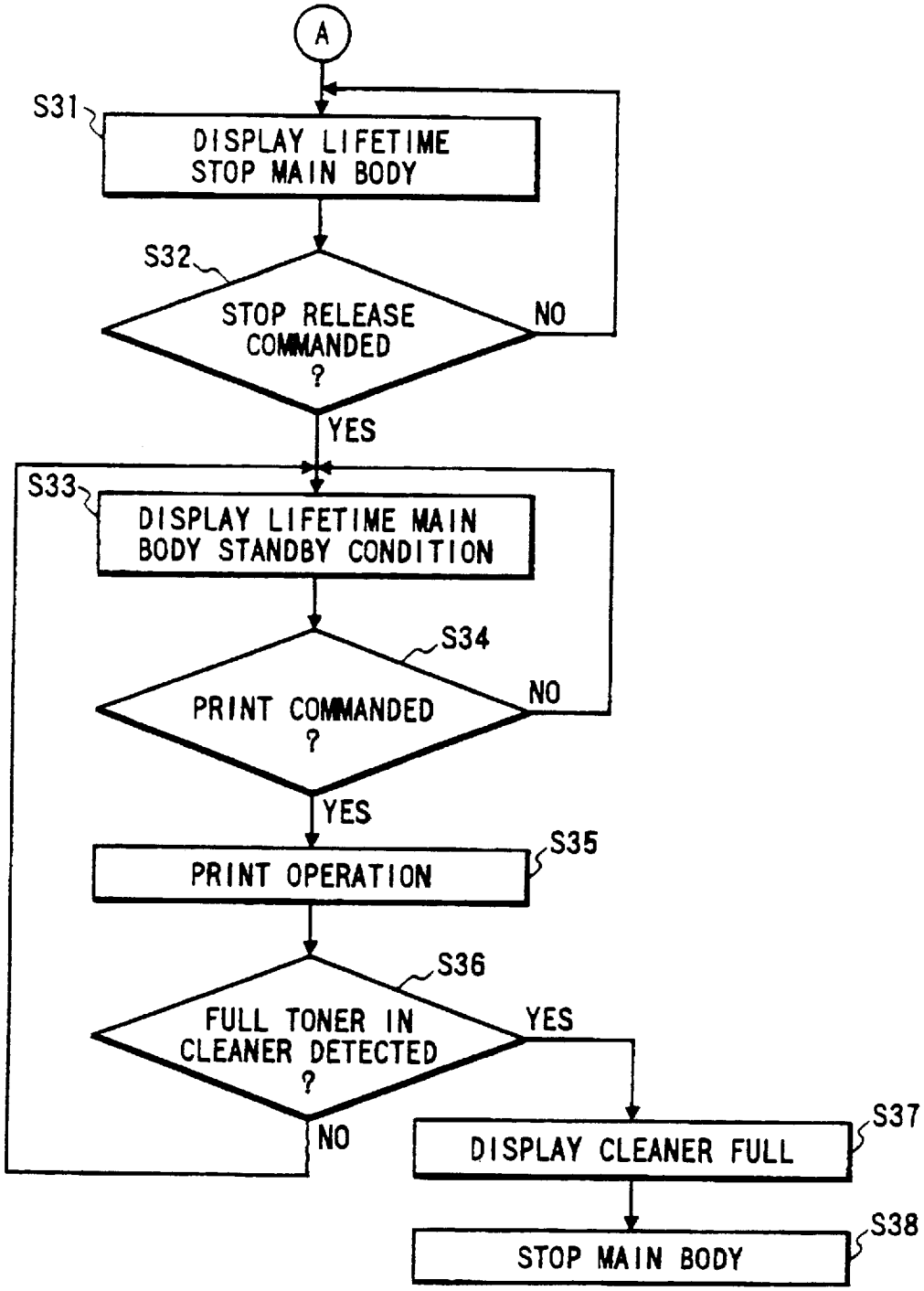

The control method in the present embodiment is as shown in the flow charts of FIGS. 8A and 8B, and in the present embodiment, whether the container 25*b* of the cleaning device 25 has become full is judged at first (S21). That is, design is made such that CPU 21 reads information from the light receiving element 24 and the fullness of the container 25*b* of the cleaning device 25 is judged when the light is no longer detected.

When it is judged that the container 25*b* of the cleaning device 25 is full, the fullness of the container 25*b* is displayed (S22), and stop the image forming operation (S23).

On the other hand, when it is judged that the container 25*b* is not full, the used state α of the photosensitive drum 1 is compared with the comparative value β1 by the CPU 21 thereafter (S24), and when α<β1, it is not displayed that the cartridge had better be interchanged or the cartridge has reached its life. However, the image forming apparatus is initialized to be warmed up and brought into its standby condition (S25). Then, the printing operation is performed in accordance with an image forming signal (S26). At this time, the used state, i.e., the calculated value α conforming to the above-mentioned wear factor, is counted in the CPU 21 (S27). The used state α is renewed and is written into the memory 20 of the cartridge (S28).

On the other hand, when at the step 24, the used state α becomes the same as the comparative value β1 or greater than the comparative value β1, a signal for demanding the interchange of the process cartridge is produced and displayed (S29).

Then, the used state α is compared with the comparative value β2 by the CPU 21 (S30), and when α<β2, the apparatus enters the standby condition (S25). When the used state a has become the same as the comparative value β2 or greater than the comparative value β2, it is informed that the process cartridge has reached the end of its life, and with this end of its life, the image forming operation is stopped (S31).

The steps S31 to S35 of the present embodiment are similar to the steps S8 to S12 of Embodiment 1, and the user effects the judgment after the release of the stoppage.

Each time the printing operation is performed after the release of the stoppage, the quantity of toner in the container 25*b* of the cleaning device 25 is detected (S36), and at a stage whereat the container 25*b* has become full of the toner. That effect is displayed (S37), and control is effected so as to stop the image forming operation (S38).

After it has thus been detected by the fullness detecting means 23 and 24 that the waste toner in the container 25*b* has reached a predetermined quantity, a stoppage releasing command is not received and therefore, an effect similar to that of Embodiment 1 is obtained while the contamination of the interior of the apparatus by the fall of the toner from the cleaning device 25 is reliably prevented. Also, by adopting such control, the volume of the container 25*b* of the cleaning device 25 need not be made larger than necessary as in Embodiment 1 to 3. Further, it is of course possible to control as in Embodiments 2 and 3 after whether the cleaner is full has been judged by the use of such cleaner fullness detecting means, and again in such case. Each time the printing operation is performed after the release of the stoppage, the control can be effected while the quantity of toner in the cleaner is detected.

Embodiment 6

Embodiment 6 of the present invention will now be described with reference to FIGS. 9 and 10.

Figure 9:
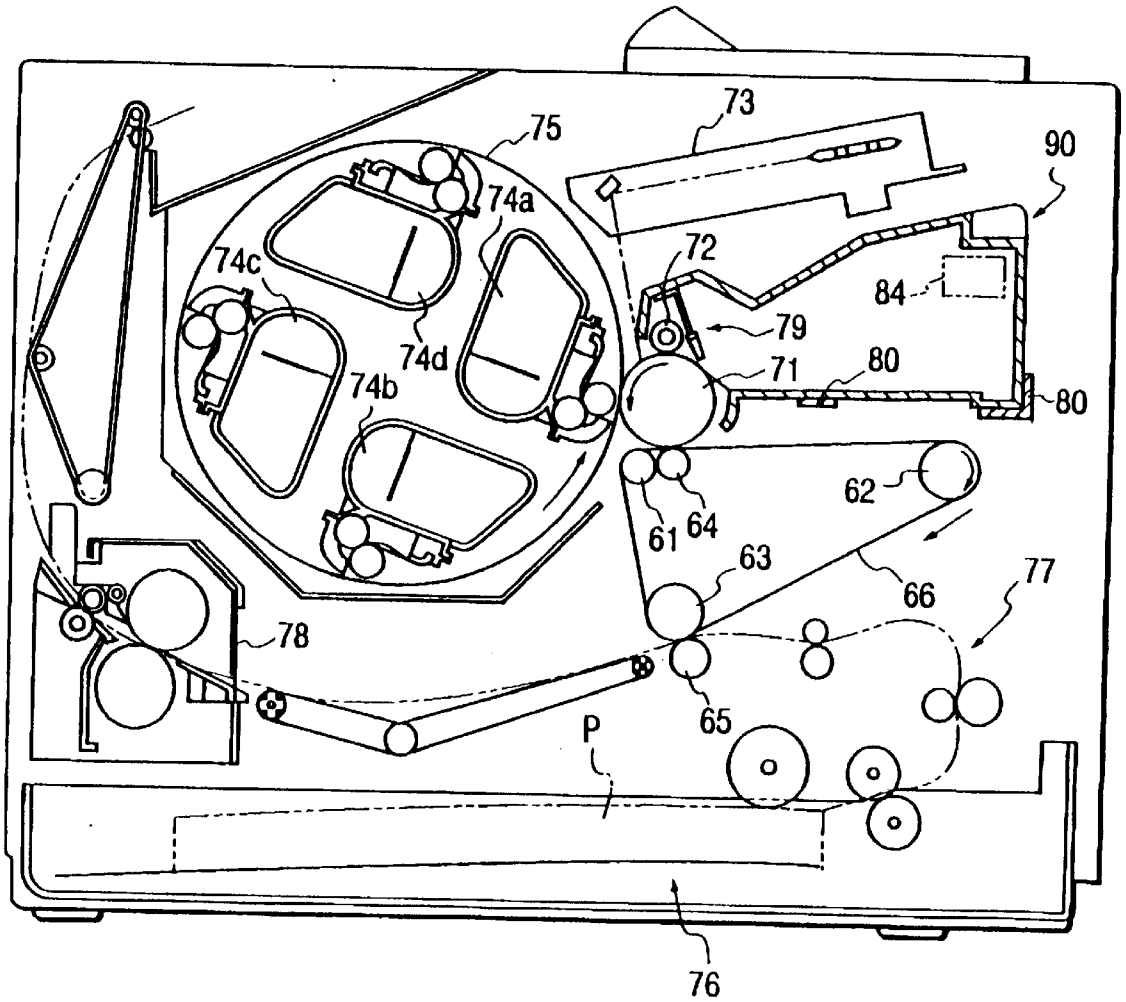
FIG. 9 schematically shows the construction of an image forming apparatus to which Embodiment 6 of the present invention is applied.
Figure 10:
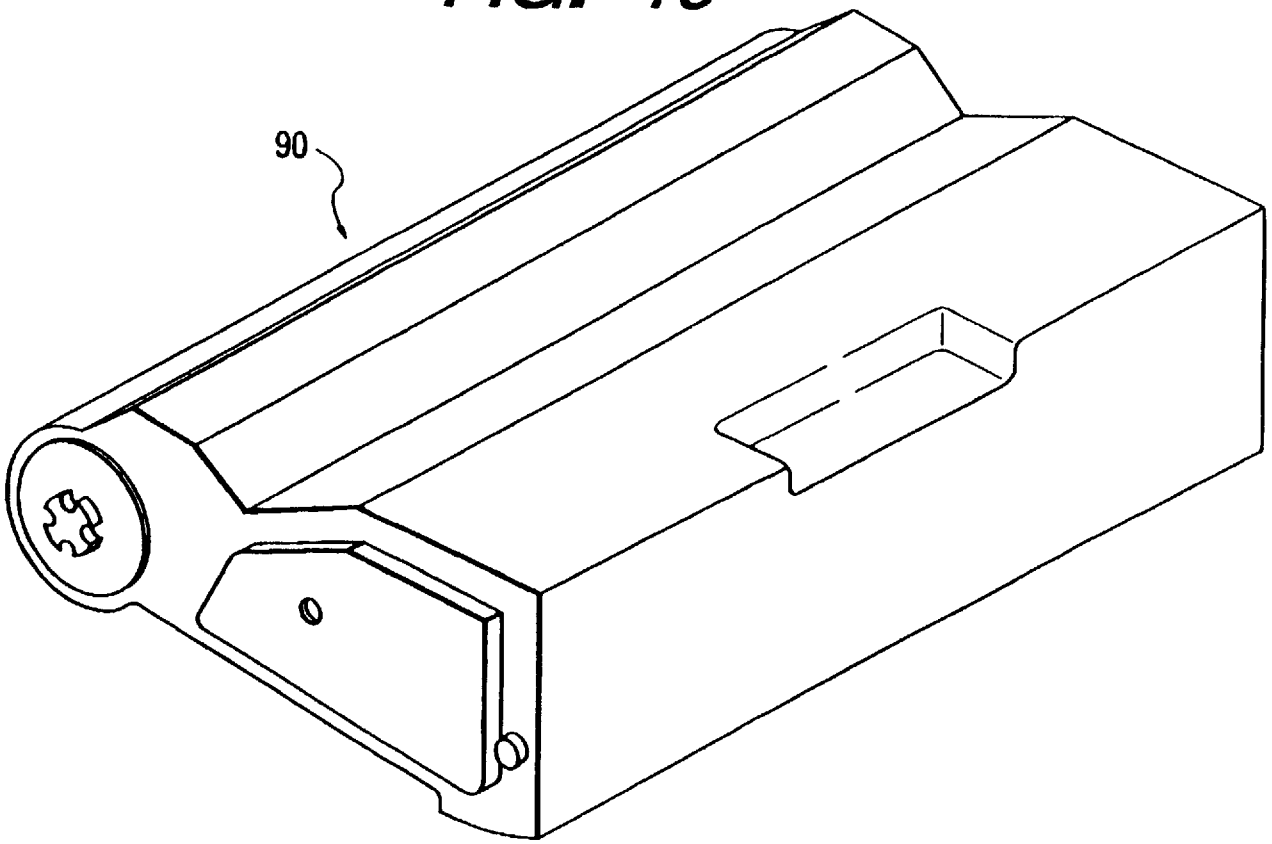
FIG. 10 is a pictorial perspective view showing a process cartridge mounted on the image forming apparatus of FIG. 9.

In Embodiments 1 to 5, the invention has been described with respect to a case where it is applied to the monochromatic laser beam printer shown in FIG. 1 or 7, but in Embodiment 6, the present invention is applied to a full color laser beam printer of yellow, magenta, cyan and black shown in FIGS. 9 and 10.

In FIG. 9, a photosensitive drum 71 is driven in the direction of arrow by drive means and is uniformly charged to predetermined potential by a roller charger 72. Then, by an exposure device 73 to which a signal conforming to a yellow image pattern has been inputted, a laser beam is applied to the photosensitive drum 71, on which a latent image is thus formed.

Further, as the photosensitive drum 71 is advanced in the direction of arrow, a supporting member 75 is rotated so that among developing devices 74*a*, 74*b*, 74*c* and 74*d* supported by the supporting member 75, for example, the developing device 74*a* in which a yellow toner is contained may be opposed to the photosensitive drum 71, and the above-mentioned latent image is visualized by the developing device 74*a*. The thus developed toner image is then transferred onto an intermediate transfer belt 66 which is an intermediate transfer member. The intermediate transfer belt 66 is passed over three supporting rollers 61, 62 and 63, and by the supporting roller 62 which is connected to a drive source (not shown), being rotated, the intermediate transfer belt is moved in the direction of arrow. Also, a primary transfer roller 64 is provided on that portion of the inside of the intermediate transfer belt 66 which is opposed to the photosensitive drum, and a predetermined bias is applied thereto from a high voltage source, so that the toner on the photosensitive drum 71 is transferred onto the intermediate transfer belt 66.

The above-described process is further carried out, for example, in the order of magenta, cyan and black by the developing devices 74*b*, 74*c* and 74*d*, so that a toner image of four colors is formed on the intermediate transfer belt 66.

This toner image of four colors is collectively transferred by a secondary transfer roller 65 onto transfer sheet conveyed from a sheet supply device 76 through conveying means 77 in synchronism with the movement of the intermediate transfer belt 66. Further, the transfer sheet has the toners thereon melted and fixated by a heating and pressure-fixating device 78, to obtain a colored image. Any untransferred toner on the photosensitive drum 71 is removed by a cleaning device 79 provided with blade means.

Also, in the present embodiment, the charging roller 72, the photosensitive drum 71 and the cleaning device 79 are integrally constructed into a process cartridge 90 having such appearances as shown in FIG., 10 and removably mountable with respect to the apparatus body by mounting guide means 80. Further, the process cartridge is provided with memory means 84 functionally similar to the memory 20 in the above-described embodiments.

Each of the developing devices 74*a* to 74*d* of four colors, like the process cartridge, is removably mountable with respect to the apparatus body. Thus, the interchange and maintenance of the above-described members heretofore done by a serviceman can be simply done by the user.

By the present invention being applied to the full color image forming apparatus of such construction as described above, an operational effect similar to that of Embodiment 1 to 5 can be obtained.

The present invention is not restricted to Embodiments 1 to 6, but various changes are possible within the scope of the present invention.

As is apparent from the foregoing description, according to the present invention, there can be provided an image forming apparatus which enables the printing operation to be performed on the basis of a user's own judgment in compliance with a user's many requirements when there is no possibility of giving rise to a problem such as the trouble of the apparatus and which is good in operability and working property, and a process cartridge mountable with respect to this image forming apparatus.

What is claimed is:

1. An image forming apparatus comprising:

an image bearing member;

image forming means for forming a developer image on said image bearing member;

cleaning means for cleaning said image bearing member;

a container for containing therein a developer removed from said image bearing member;

life detecting means for detecting a life of a consumptive part of said apparatus;

fullness detecting means for detecting whether a quantity of the developer in said container has reached a predetermined quantity or not;

operation stopping means for stopping the operation of said image forming means when it receives a detection signal of said life detecting means or a detection signal of said fullness detecting means; and releasing means for releasing a stoppage of the operation of said image forming means, said releasing means receiving a releasing signal when the operation is stopped by the detection signal of said life detecting means, and rejecting the releasing signal when the operation is stopped by the detection signal of said fullness detecting means.

2. An image forming apparatus according to claim 1, wherein said consumptive part is said image bearing member.

3. An image forming apparatus according to claim 1, wherein said image bearing member and said container are made into a unit to be removable from said apparatus.

* * * * *

UNITED STATES PATENT AND TRADEMARK OFFICE

CERTIFICATE OF CORRECTION

PATENT NO. : 5,822,646

DATED : October 13, 1998

INVENTORS : Masahide Kinoshita, et al.

It is certified that error appears in the above-identified patent and that said Letters Patent is hereby corrected as shown below:

COLUMN 2

Line 55, please change "cartridge and" to --cartridge,--.

COLUMN 6

Line 37, "value a" should read --value α--;
Line 45, "a" should read --α--; and
Line 61, "a" (second occurrence) should read --α--.

COLUMN 7

Line 4, "a" should read --α--; and
Line 39, "Can" should read --can--.

COLUMN 8

Line 44, "a" should read --α--.

COLUMN 9

Line 64, "stop" should be deleted.

LIne 65, after "(S23)" insert --stops--.

UNITED STATES PATENT AND TRADEMARK OFFICE

CERTIFICATE OF CORRECTION

PATENT NO. : 5,822,646

DATED : October 13, 1998

INVENTORS : Masahide Kinoshita, et al.

It is certified that error appears in the above-identified patent and that said Letters Patent is hereby corrected as shown below:

COLUMN 10

Line 20, "a" should read --α--.

Signed and Sealed this

Sixth Day of July, 1999

*Attest:*

Q. TODD DICKINSON

*Attesting Officer*

*Acting Commissioner of Patents and Trademarks*